US007007837B2

(12) United States Patent
Correll

(10) Patent No.: US 7,007,837 B2
(45) Date of Patent: Mar. 7, 2006

(54) BOX WITH ARTICLE-RETAINING STRUCTURE

(76) Inventor: John D. Correll, 8459 Holly Dr., Canton, MI (US) 48187-4237

( * ) Notice: Subject to any disclaimer, the term of this patent is extended or adjusted under 35 U.S.C. 154(b) by 481 days.

(21) Appl. No.: 10/411,762

(22) Filed: Apr. 11, 2003

(65) Prior Publication Data

US 2004/0200891 A1 Oct. 14, 2004

(51) Int. Cl.
*B65D 5/481* (2006.01)
*B65D 5/483* (2006.01)
*B65D 5/484* (2006.01)

(52) U.S. Cl. ..... 229/120.05; 229/120.18; 229/120.21; 229/904; 229/906

(58) Field of Classification Search ..... 229/120.05, 229/120.18, 120.21, 902, 904, 906; 206/562, 206/563, 564, 565
See application file for complete search history.

(56) References Cited

U.S. PATENT DOCUMENTS 2,097,682 A * 11/1937 Andersen ..... 229/120.14
2,132,632 A * 10/1938 Kondolf ..... 206/427
2,271,243 A * 1/1942 Barker ..... 229/120.18
2,375,843 A * 5/1945 Gottlieb ..... 206/784
2,457,291 A * 12/1948 Wenzel ..... 206/45.29
2,670,124 A * 2/1954 Buchmiller et al. ..... 206/563
2,924,372 A * 2/1960 Kirkeby ..... 206/563
3,899,119 A * 8/1975 Roccaforte ..... 206/562
3,907,108 A * 9/1975 Weimer, Jr. et al. ..... 206/317
4,765,534 A * 8/1988 Zion et al. ..... 229/109
5,788,081 A * 8/1998 Bates ..... 206/562
5,890,648 A * 4/1999 Cai ..... 229/120.05
6,092,715 A * 7/2000 Correll ..... 229/110
6,568,586 B1 * 5/2003 VanEsley et al. ..... 229/120.18

OTHER PUBLICATIONS

Kickers Box—photos taken by John Correll on Nov. 24, 2002.

* cited by examiner

*Primary Examiner*—Gary E. Elkins

(57) ABSTRACT

A box comprising one or both of first and second article-retaining structures, with the first article-retaining structure comprising a first panel attached to a top edge of a wall panel of the box and the second article-retaining structure comprising a first panel attached to an end of a wall panel.

29 Claims, 4 Drawing Sheets

BOX WITH ARTICLE-RETAINING STRUCTURE

FIELD OF THE INVENTION

This invention relates to packaging in general and in particular to cartons for food products such as pizza, breadsticks, chicken wings, and the like.

BACKGROUND OF THE INVENTION

In the pizza and food-to-go industries, millions of orders of side-item type products are sold each year. Examples of such products include breadsticks, chicken wings, and pizza slices. One of the most prevalent types of cartons used for packaging these products is the corrugated paperboard carton. This carton comes in both folder type and clamshell type. The folder type carton is shipped as a flat blank and then erected into a carton at the point of use (i.e., the pizzeria). The clamshell type carton is erected in the factory and then shipped as an open clamshell.

These cartons can be categorized into two groups based on status of wall engagement. The two groups are (1) wall-engaged cartons and (2) non-wall-engaged cartons. A "wall-engaged carton" is one in which at least two wall structures are engaged one to the other, such that when the cover of the carton is in opened disposition those two wall structures remain in an erected position. A "non-wall-engaged carton" is one in which none of the wall structures of the carton are engaged one to another.

Many pizzerias pack one or more articles, such as a sauce cup, with their side-item products. Traditionally these cups have been placed next to the food product. However, there are two problems with this. First, the sauce cup often gets greasy. Second, some health departments consider it to be unsanitary for articles handled by human hands to come into contact with a ready-to-eat food product. As a result, it would be desirable to have a way of packing sauce cups and other articles so that these articles are positioned out of contact with the food product.

One prior art box has been invented to address this problem. Known as the "Kickers Box," it is used by Domino's Pizza for packaging chicken strips (which the company calls Kickers™). Essentially, the Kickers™ Box is a small version of the company's hexagonal D-type pizza box except with a special compartment at the front third of the box for holding two sauce cups. The compartment is created by a plurality of three interconnected panels. The first panel is attached to the top edge of the front wall of the box and is disposed parallel to the bottom panel. It has two holes in it for holding two sauce cups. The second panel is attached to the first panel and is disposed perpendicular to the first panel and serves as support for the first panel. The third panel is attached to the second panel and is disposed perpendicular to the second panel and is tucked underneath the connector panels that connect the two diagonal walls to the front wall structure of the box. (A box of similar construction to the Kickers™ Box is the Dots™ Box, also used by Domino's Pizza.)

This box is particularly defined in VanEsley et al. U.S. Pat. No. 6,568,586 granted May 27, 2003.

However, the Kickers™ Box has at least three drawbacks. First, it consumes a relatively large amount of material and, therefore, is relatively expensive. Second, it contains numerous flaps and, therefore, is time-consuming and awkward to erect from a blank into a box. Third, after product has been placed into the box, closing the cover on the box can be time-consuming due to the many cover flaps that need to be manipulated for tuck-in. In view of these three problems, it would be desirable to have a carton for side-item products that is material-saving, cost efficient, and easy-to-handle.

In conclusion, it would be highly desirable to provide a box that overcomes the above-described disadvantages. These drawbacks have not been solved by the prior art but are solved by my invention.

SUMMARY OF THE INVENTION

My invention is a box having one or more of the following structural arrangements:

1. (a) An article-retaining structure comprising a cover engagement means and a first panel attached to a top edge of a wall panel and (b) a cover panel having a minimum front-to-rear length that is substantially shorter than a front-to-rear length of a bottom panel and a projecting portion disposed adjacent a cover front flap;

2. (a) An article-retaining structure comprising a first panel attached to a top edge of a wall panel and holding a food-containing cup and (b) a cover engagement means that is disposed at least ten millimeters rearward of a front wall panel and (c) a cover panel having a projecting portion covering at least a portion of the food-containing cup;

3. (a) An article-retaining structure comprising a first panel attached to a top edge of a front wall panel and (b) a cover panel that overlies a portion of the first panel and another portion of the first panel being free of coverage by the cover panel; and 4. An article-retaining structure comprising (a) a first panel hingedly attached to an end of a wall panel and (b) a second panel hingedly attached to the first panel and having a panel-positioning means engaging with another panel of the box.

My invention typically would be used for packaging side-item products such as breadsticks, chicken wings, and the like; however, it could take other forms for other purposes, as well.

A complete understanding of the invention can be obtained from the detailed description that follows.

OBJECT AND ADVANTAGES

The main object of my invention is a box that provides for easy, efficient packaging of additional articles, such as sauce cups, with other food products.

The advantages of my invention are (1) material savings and (2) cost savings over the prior art packaging having an article-retaining structure.

Further objects and advantages of the invention will become apparent from consideration of the following detailed description, related drawings, and appended claims.

LIST OF REFERENCE NUMERALS

Figure 1:
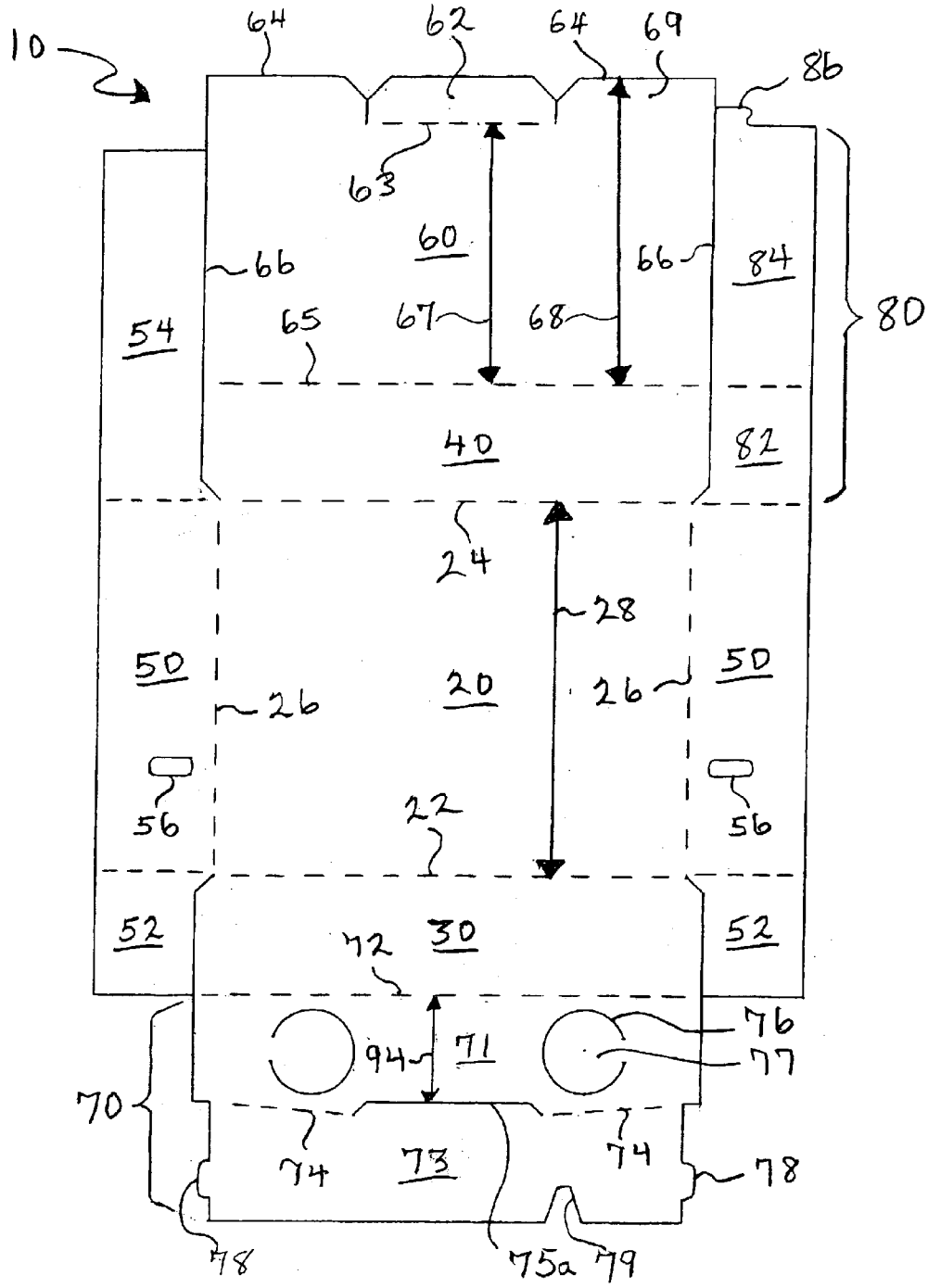
FIG. 1 is a plan view of the blank of the preferred embodiment.

Within a drawing, closely related components have the same number. Between drawings and between embodiments, like reference numerals designate corresponding parts.

10 blank of the preferred embodiment
12 fully-erected box created from the blank
14 opened box created from the blank
16 blank for alternate embodiment
20 bottom panel
22 front bottom panel edge
24 rear bottom panel edge
26 left and right bottom panel edges
28 front-to-rear length of bottom panel
30 front wall panel
40 rear wall panel
50 left and right wall panels
52 front corner flap
54 rear corner flap
56 hole or slot (panel-securing means)
60 cover panel
62 cover front flap
63 cover front flap fold line
64 front cover edge
65 rear cover edge
66 left and right cover edges
67 first front-to-rear length of cover panel (minimum front-to-rear cover panel length)
68 second front-to-rear-length of cover panel
69 projecting portion of cover panel
70 first article-retaining structure
71 first panel
72 first fold line
73 second panel
74 second fold line
75*a* slot-forming slit (cover engagement means)
75*b* cover flap receiving slot (formed from slot-forming slit)
76 cup-holder opening
77 hole-opening flap
78 tab (panel-positioning means)
79 notch (panel-securing means)
80 second article-retaining structure
82 first panel
84 second panel
86 hook-like tab (panel-positioning means)
90 ridge of material
92 food cup
94 distance that the flap-receiving slot is rearward of the front wall
100 diagonal wall panel
102 first connector panel
104 second connector panel
106 flap (cover engagement means)

DESCRIPTION OF A PREFERRED EMBODIMENT

Referring now to the drawings, there is illustrated a preferred embodiment of the invention in the format of a one-piece corrugated blank and, correspondingly, in the format of a box created from the blank. The intended use for the embodiment is as a food carton or, specifically, as a box for packaging side-items such as breadsticks, chicken wings, pizza slices, and the like. However, it will be appreciated, as the description proceeds, that my invention may be realized in different embodiments and may be used in other applications.

Figure 2:
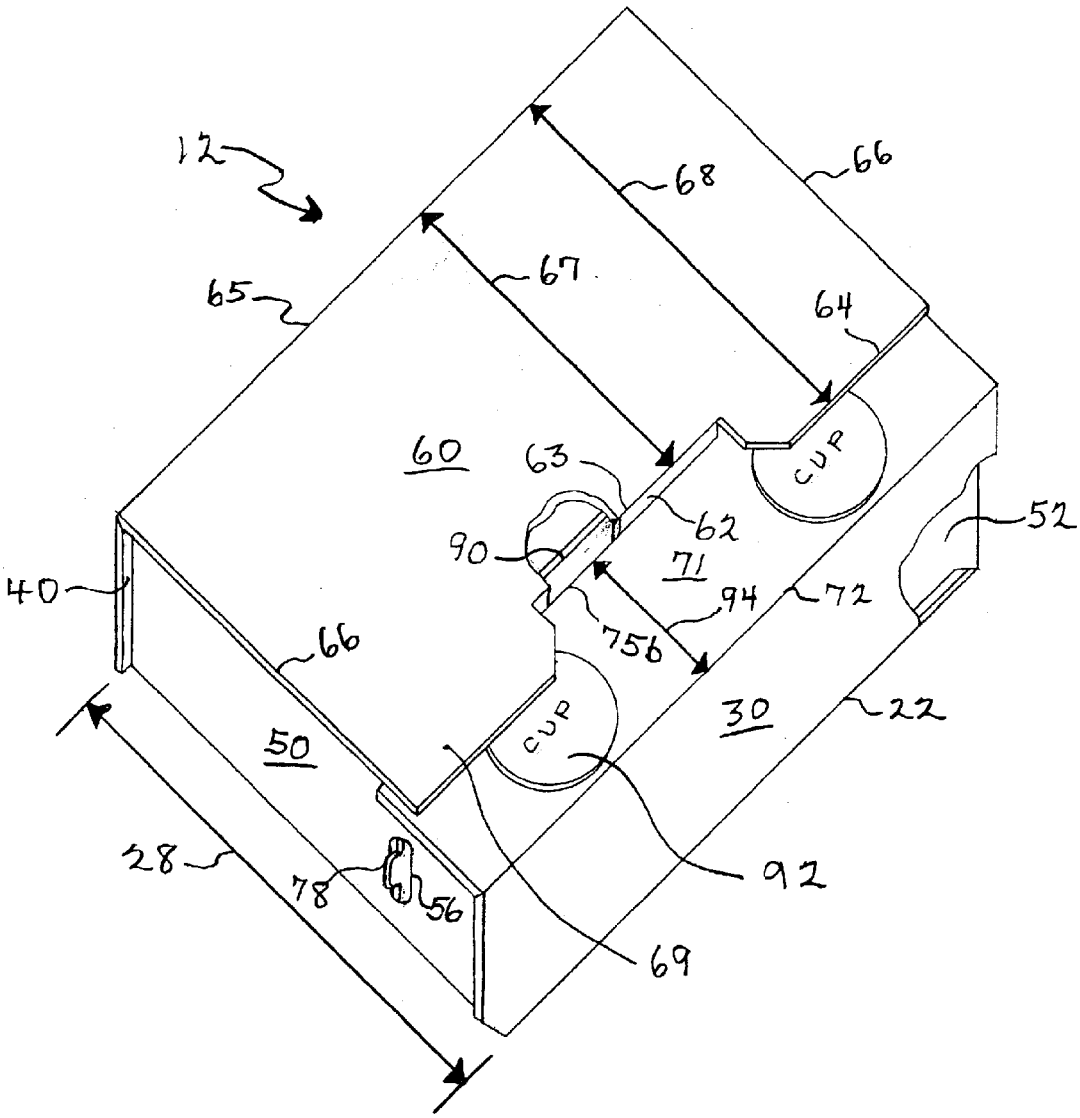
FIG. 2 is a front perspective view of the fully-erected box created from the blank.
Figure 3:
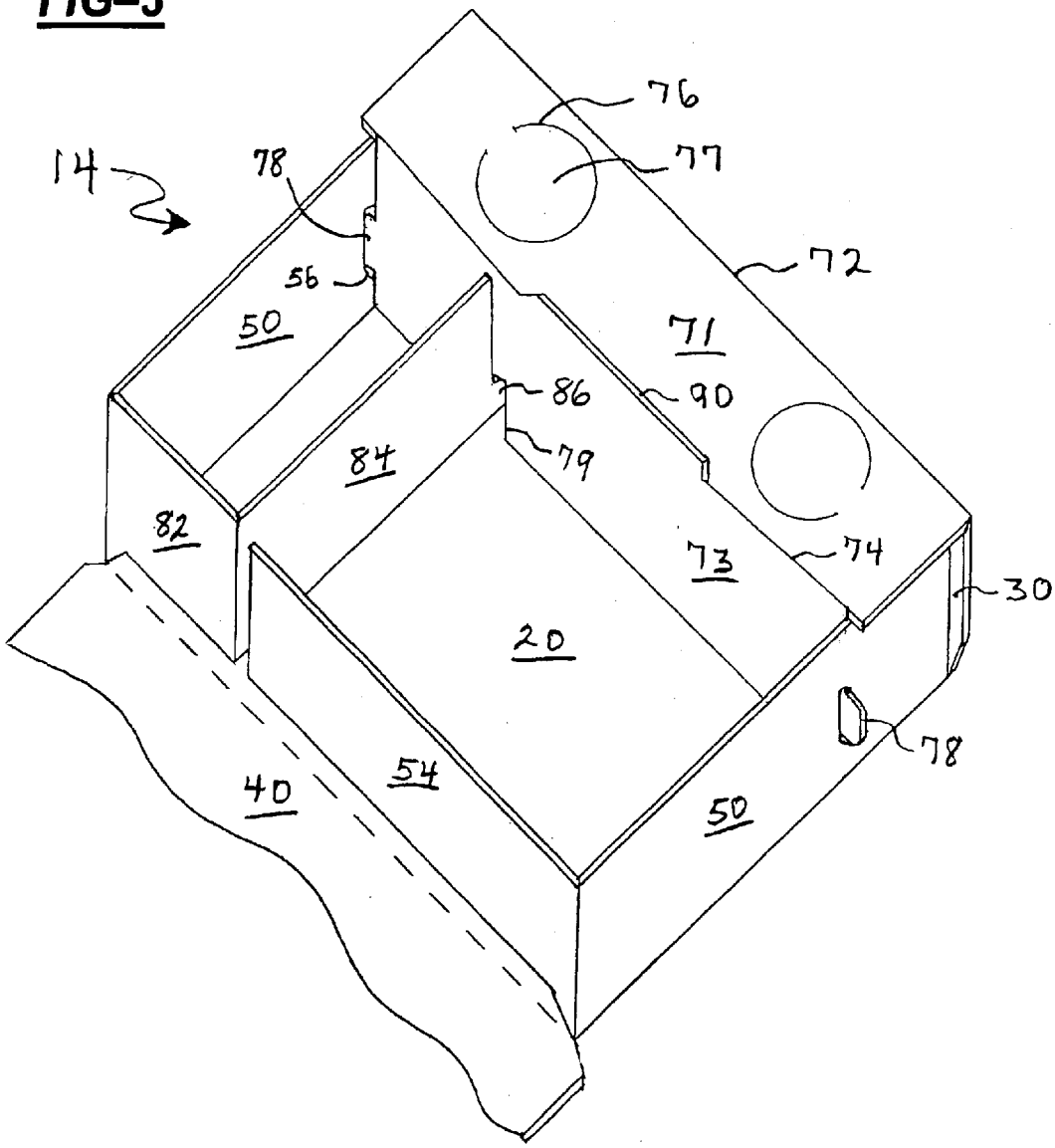
FIG. 3 is a partial rear perspective view of the box in opened disposition.

FIG. 1 shows a blank 10 and FIGS. 2 and 3 show a fully-erected box 12 and an opened box 14, respectively, created from blank 10. Referenced components are labeled in FIG. 1; selected components are labeled in other Figures. Corresponding parts between drawings share a same reference numeral. It is noted that the invention is bilaterally symmetrical. Therefore, pairs of opposing like components are to be found, with one item of the pair on each side of the blank or carton. For simplicity of labeling, each component of the opposing pair will have the same reference numeral. Also, a pair may be indicated by a numeral on one side of the drawing only. Where this occurs, it is to be understood that the discussion also applies to the corresponding component on the other side, even though that component may not be numerically labeled.

Structure of the Embodiment

Referring particularly to blank 10 of FIG. 1, there is a bottom panel 20, opposing front and rear wall panels 30 and 40, respectively, and opposing left and right wall panels 50.

Bottom panel 20 has front and rear bottom panel edges 22 and 24, respectively, and left and right bottom panel edges 26 and a predetermined front-to-rear length 28 extending between front and rear edges 22, 24.

Hingedly attached to a top edge of rear wall panel 40 is a cover comprising a cover panel 60 and a cover front flap 62 hingedly attached to cover panel 60 at a cover flap fold line 63. Cover panel 60 has front and rear cover edges 64 and 65, respectively, and left and right cover edges 66. It is noted that left and right edges 66 are free of attachment. Further, cover panel 60 has two key front-to-rear dimensions. The first dimension is front-to-rear dimension 67 which extends between rear cover edge 65 and cover flap fold line 63. The second dimension is front-to-rear dimension 68 which extends from rear cover edge 65 to front cover edge 64.

Cover panel 60 has a predetermined minimum front-to-rear length. This length is the lesser length of either front-to-rear dimension 67 or front-to-rear dimension 68. Since dimension 67 is shorter than dimension 68, dimension 67 represents the predetermined minimum front-to-rear length of cover panel 60. It is also noted that a portion of cover panel 60 extends beyond cover flap fold line 63. This portion of the cover panel is, in effect, that area of the cover panel where dimension 68 extends beyond dimension 67. The general area of this portion is indicated by numeral 69 and, for reference purposes, is referred to as "projecting portion 69." It is noted that projecting portion 69 is disposed laterally adjacent to, or to the side of, cover front flap 62.

It is important to note that the predetermined minimum front-to-rear length (or dimension 67) of cover panel 60 is substantially shorter than predetermined front-to-rear length 28 of bottom panel 20.

The dimensional relationship cited in the preceding paragraph is defined in the appended claims by the term "substantially shorter." As used in the claims, the term "substantially shorter" means "at least ten percent shorter."

Hingedly attached to a front end of each of left and right wall panels 50 is a front corner flap 52. Hingedly attached to a rear end of left wall panel 50 is a rear corner flap 54. Disposed within each of left and right wall panels 50 is a panel-securing means 56 for holding a panel of an article-retaining structure in a fixed position. In the preferred embodiment, panel-securing means 56 is a hole, or slot, in the board. Although a hole is the preferred embodiment of panel-securing means 56, other means for securing a panel known to those skilled in the art could be used, such as for example a slit in the board, and, if it were used, would be considered to fall within the scope of the instant invention.

Attached to front wall panel 30 is a first article-retaining structure 70 which comprises a first panel 71 hingedly attached at a first fold line 72 to a top edge of front wall panel 30 and a second panel 73 hingedly attached at a second fold line 74 to first panel 71. Article-retaining structure 70 also includes a cover engagement means 75*a* for holding cover panel 60 in a closed disposition when the box is in a fully-erected format (shown in FIG. 2). In the preferred embodiment, cover engagement means 75*a* is a slot-forming slit that opens into a slot 75*b* (see FIG. 2) for receiving cover front flap 62 when the blank is erected into a box. It is noted that cover engagement mean 75*a* is disposed adjacent second fold line 74. Although a slot-forming slit is the preferred embodiment of cover engagement means 75*a*, other means for securing a cover panel known to those skilled in the art could be used, such as for example a slot, and, if it were used, would be considered to fall within the scope of the instant invention.

Disposed within first panel 71 are a pair of cup-holder openings 76, each of the openings having a hole-opening flap 77 which fills the opening until an object is inserted into it, whereby the hole-opening flap is pushed downward and out of the way.

Article-retaining structure 70 also includes a panel-positioning means 78 for holding article-retaining structure 70 in a fixed position after the blank has been erected into a box. In the preferred embodiment, panel-positioning means 78 is a pair of respective left and right tabs projecting from the left and right end edges of panel 73. Although a tab is the preferred embodiment of panel-positioning means 78, other means for securing a panel into a fixed position known to those skilled in the art could be used, such as for example one or more flaps attached to panel 73, and, if it were used, would be considered to fall within the scope of the instant invention.

Disposed within second panel 73 is a panel-securing means 79 for holding a panel of a second article-retaining structure in a fixed position. In the preferred embodiment, panel-securing means 79 is a notch along the bottom edge of panel 73. Although a notch is the preferred embodiment of panel-securing means 79, other means for securing a panel known to those skilled in the art could be used, such as for example a slit or a notch-slit combination or a slot, and, if it were used, would be considered to fall within the scope of the instant invention.

Attached to right wall panel 50 is a second article-retaining structure 80 comprising a first panel 82 hingedly attached to a rear end edge of right wall panel 50 and a second panel 84 hingedly attached to panel 82. Article-retaining structure 80 also includes a panel-positioning means 86 for holding article-retaining structure 80 in a fixed position after the blank has been erected into a box. In the preferred embodiment, panel-positioning means 86 is a tab projecting from an end of panel 84 and having a hook-like shape, otherwise called a hook-like tab. Although a hook-like tab is the preferred embodiment of panel-positioning means 86, other means for securing a panel into a fixed position known to those skilled in the art could be used, such as for example a flap, and, if it were used, would be considered to fall within the scope of the instant invention.

The Erected Box Format

Referring now to FIGS. 2 and 3, there is shown the box in a fully-erected closed format and in an opened format, respectively.

In the fully-erected format, all of the wall panels are disposed perpendicular to bottom panel 20 and the article-retaining structures are each in a particular erected disposition.

As regards first article-retaining structure 70, first panel 71 is disposed substantially perpendicular to front wall panel 30 and parallel to bottom panel 20. Second panel 73 is disposed substantially perpendicular to first panel 71 and parallel to front wall panel 30. Each panel-positioning means (or tab) 78 is disposed in an adjacent panel-securing means (or slot) 56, whereby article-retaining structure 70 is held in a fixed position.

As regards second article-retaining structure 80, first panel 82 is disposed substantially perpendicular to right wall panel 50 and parallel to rear wall panel 40. Second panel 84 is disposed substantially perpendicular to first panel 82 and parallel to right wall panel 50. Panel-positioning means (or hook-like tab) 86 is engaged with panel-securing means (or notch) 79, whereby article-retaining structure 80 is held in a fixed position.

Slot-forming slit 75*a* (a.k.a. cover engagement means 75*a*) has opened into cover flap receiving slot 75*b* (FIG. 2). This slot holds cover front flap 62 when the box is in a fully-erected (closed) disposition. Resulting from the opening up of slot-forming slit 75*a*, an upward-extending ridge 90 is created. Cover panel 60 overlies ridge 90 and cover front flap 62 extends downward and into slot 75*b*.

In FIG. 2, each cup-holder opening 76 is shown holding a food-containing cup 92. A portion of each of the projecting portions 69 of cover panel 60 overlies a portion of one of the food cups 92 while another portion of the food cup is exposed to view. By covering a portion of the cup with the cover panel, it prevents the cup from falling out of cup-holder opening 76 during transit.

Several key features of the erected box should be noted. First, cover panel 60 overlies a portion of first panel 71 and another portion of panel 71 is exposed to view. Second, a portion of each projecting portion 69 of cover panel 60 overlies a portion of each food cup 92 and another portion of the food cup is exposed to view. Third, cover flap receiving slot 75*b* (a.k.a. cover engagement means 75*a*) is positioned rearward of front wall panel 30 by a distance 94. Distance 94 is at least ten millimeters, but is approximately fifty millimeters in the preferred embodiment. Fourth, rear corner flap 54 extends substantially all the way from left wall panel 50 to article-retaining structure 80 (see FIG. 3). This results in a "pseudo rear wall" when the box is in an opened disposition, as shown in FIG. 3. Although not shown in the preferred embodiment, it's possible to include a hook-like tab on the end of rear corner flap 54 and a slot or notch in the vicinity of the fold line where panels 82 and 84 intersect, whereby the tab can be inserted into the slot and, thereby, rear corner flap 54 will be held more readily in a fixed position. If such were done it would be considered to be within the scope of the instant invention.

In the erected format, first panel 71 overlies front corner flaps 52 and the corner flaps are disposed adjacent and parallel to front wall panel 30.

Operation of the Embodiment

Following is a procedure for erecting blank 10 into box 12.

First, using both hands grasp the blank at the front ends of left and right wall panels 50. Hold the blank vertically with the outside facing you and the cover down.

Second, simultaneously fold the left and right front corner flaps 52 inward to a perpendicular position to the respective left and right wall panels, and then fold the left and right wall panels inward to an upright position.

Third, while holding panels 50 in an upright position, fold front wall panel 30 to an upright position and then fold first panel 71 downward to a position perpendicular to front wall panel 30. At this point panel 71 overlies front corner flaps 52.

Fourth, fold second panel 73 downward to a position perpendicular to panel 71, which should result in tabs 78 sliding into slots 56. To make tabs 78 clear the top edge of left and right wall panels 50, it may be necessary to momentarily bend the top edge of wall panels 50 outward to allow tabs 78 to slide to the interior side of the wall panels. The exact dimensions of the width of panel 73 and the size of tabs 78 can vary from box to box depending on the type of flute used in the corrugated board as well as other factors. So testing may be needed to determine exact dimensions for optimal folding and box operation.

Fifth, fold first panel 82 to a position perpendicular to right wall panel 50 and then fold second panel 84 to a position perpendicular to panel 82. Finally, slide hook-like tab 86 into notch 79 in panel 73 so that an edge of panel 73 becomes engaged with the tab. The exact dimensions of the tab and notch for optimal operation can vary from box to box depending on the type of flute used in the corrugated board as well as other factors. So testing may be needed to determine exact dimensions for optimal operation.

Sixth, fold rear corner flap 54 inward.

Seventh, fold cover panel 60 forward and tuck cover front flap 62 into cover flap receiving slot 75*b*.

Note: Depending on the type of corrugated board and fold lines that are used in making the box blank, it may be necessary to reduce the resiliency, or spring-back tendency, of certain fold lines prior to erecting the blank into the box (using the above procedure). To greatly reduce the resiliency of a fold line, fold a first panel toward a second panel until the first panel overlies, or lays upon, the second panel. For example, to reduce the resiliency of the fold line along edge 22 (where front wall panel 30 attaches to bottom panel 20), fold front wall 30 over until it lays flat on bottom panel 20 and then pull it back to approximately its original position. Do this prior to executing the first step of the above box-erecting procedure. This will remove much of the spring-back tendency of that particular fold line and, thereby, perhaps make it easier to execute the box-erecting procedure.

Within the drawing of the blank, a fold line between component parts of the invention is depicted with a dashed line. Within the context of this invention, a fold line can be created by a number of means such as, for example, by a crease or score in the board, by a series of aligned spaced short slits in the board, and by a combination of aligned spaced short and long slits. In conclusion, as referred to herein, a fold line is any line between two points on the blank or box along which the board is intended to be folded when the blank is being erected into a box or when the box is being manipulated as described herein. The type of fold lines shown in the drawings are presently preferred but it will be appreciated that other methods known to those skilled in the art may be used.

Description of an Alternate Configuration of the Preferred Embodiment

Figure 4:
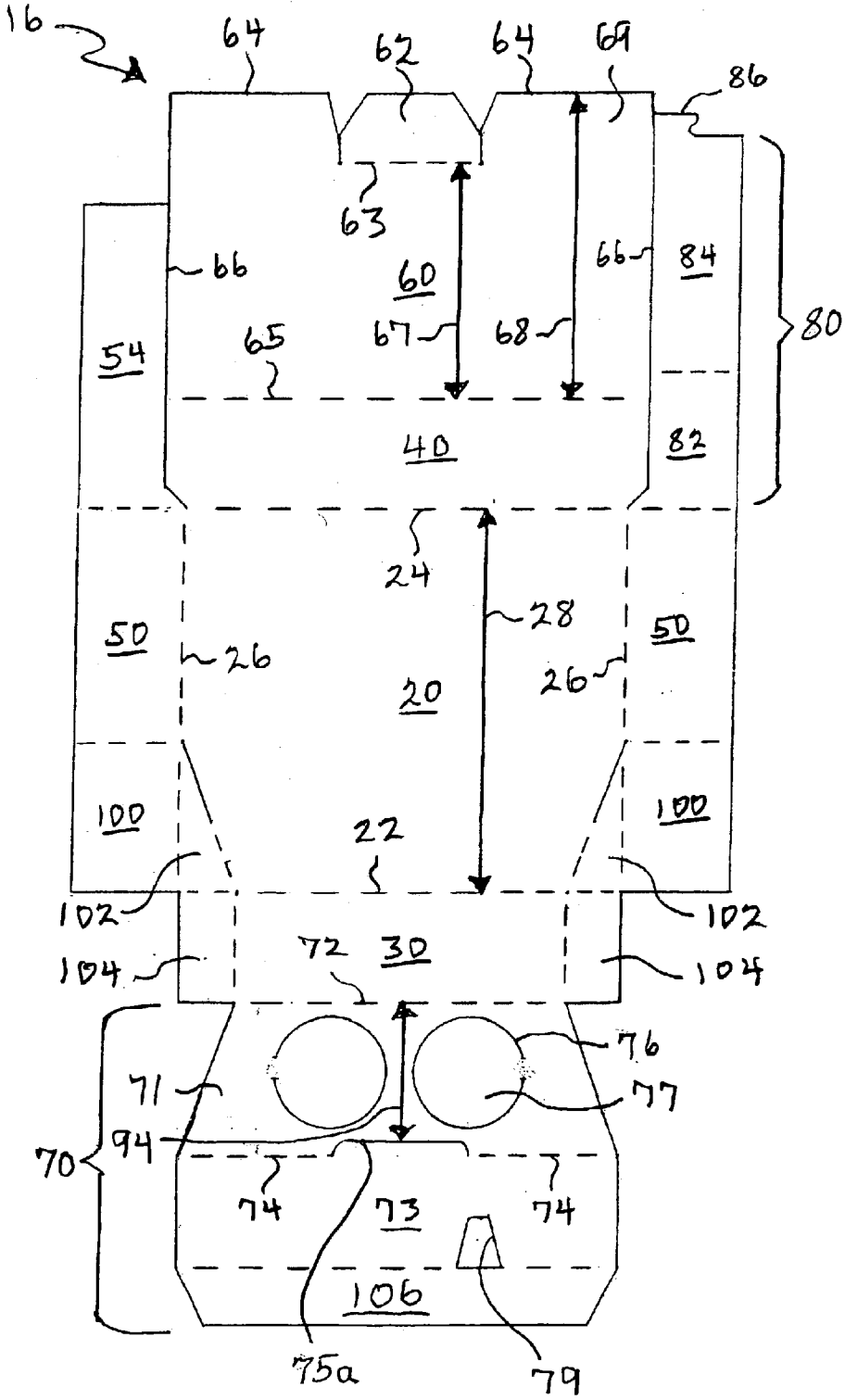
FIG. 4 is a plan view of a blank of an alternate configuration of the preferred embodiment.

Alternate configurations of the preferred embodiment are possible. One such configuration is depicted by blank 16 of FIG. 4.

Essentially, this blank 16 is the blank of the Domino's Pizza Kickers™ Box (or the similar Dots™ Box) modified to include the instant invention. Many components of blank 16 correspond to those of blank 10 of FIG. 1. Accordingly, the corresponding components of these two blanks carry the same reference numerals and, further, much of the description of blank 10 also applies to blank 16. What mainly distinguishes blank 16 from blank 10 are the following additional components incorporated within blank 16.

Hingedly attached to a front end of each of left and right wall panels 50 is a front diagonal wall panel 100. Hingedly attached to a bottom edge of each diagonal wall panel 100 is a first connector panel 102. And hingedly attached to each connector panel 102 is a second connector panel 104, which also hingedly connects to an end of front wall panel 30.

Hingedly attached to a bottom edge of second panel 73 of first article-retaining structure 70 is a flap 106, which serves as the panel-positioning means for panel 73.

The above-described additional components are all part of the Domino's Pizza Kickers™ Box. Accordingly, after blank 16 has been erected into a box, these components assume the same disposition as they do in the Kickers™ Box. Specifically, diagonal wall panel 100 extends diagonally from side wall panel 50 toward front wall panel 30. First connector panel 102 overlies and is parallel to bottom panel 20. And second connector panel 104 is disposed vertically and at an acute angle to front wall panel 30. Finally, the end portions of flap 106 are disposed in tight frictional contact between first connector panels 102 and bottom panel 20, thereby holding second panel 73 in position.

Components found in blank 10 that are missing from blank 16 are front corner flaps 52 (replaced by diagonal wall panels 100), panel-securing means 56, and panel-positioning means 78. Aside from the differences described above, blank 16 and blank 10 are substantially identical.

Blank 16 can be erected into a box by the following procedure.

First, using both hands, simultaneously fold panels 100, 102, and 104 to their upright position (described above). This will automatically cause front wall panel 30 to rise to its upright position.

Second, fold first panel 71 downward to a position perpendicular to front wall panel 30. At this point panel 71 overlies diagonal wall panels 100.

Third, fold second panel 73 downward to a position perpendicular to panel 71 while simultaneously tucking flap 106 between first connector panels 102 and bottom panel 20.

Fourth, fold first panel 82 to a position perpendicular to right wall panel 50 and then fold second panel 84 to a position perpendicular to panel 82. Finally, slide hook-like tab 86 into notch 79 in panel 73 so that an edge of panel 73 becomes engaged with the tab. The exact dimensions of the tab and notch for optimal operation can vary from box to box depending on the type of flute used in the corrugated board as well as other factors. So testing may be needed to determine exact dimensions for optimal operation.

Fifth, fold rear corner flap 54 inward.

Sixth, fold cover panel 60 forward and tuck cover front flap 62 into the cover flap receiving slot formed by slot-forming slit 75*a*.

Definition of Key Terms

Certain terms are used in the claims for describing the invention. To insure clarity of meaning those terms are now specifically defined as used herein.

A "minimum front-to-rear length" of a cover panel is the shorter of (a) the distance between the rear edge and the front edge of the cover panel and (b) the distance between the rear edge and a cover front flap fold line disposed parallel to the rear edge of the cover panel. Whichever distance of these two distances is the shorter is regarded to be the minimum front-to-rear length of the cover panel.

An "article-retaining structure" is a structural part of a box (or blank) that is intended for holding one or more articles for the purpose of retaining these articles in a relatively fixed position. It may consist of a single panel or multiple panels, and may include other components, as well. Examples of articles that might be carried in an article-retaining structure include sauce cup(s), food product(s), and eating utensil(s). The structure may comprise a horizontal panel with openings in it for holding specific objects such as a sauce cup (e.g., first article-retaining structure 70) or it may be open on the top and bounded on one or more sides for holding the objects (e.g., second article-retaining structure 80).

A "cover engagement means" is a structural part of a box (or blank) intended for engaging with a component of a cover of the box for the purpose of holding the cover in a closed position. Examples of cover engagement means include, for example, a slit, a slot, a tab, and a flap.

A "panel-securing means" is a component of a first panel or a component appending from a first panel intended for engaging with a second panel or a component appending from a second panel for the purpose of securing the second panel in a fixed position. Examples of panel-securing means include, for example, a slit, a slot, a tab, and a flap.

A "panel-positioning means" is a component of a first panel or a component appending from a first panel intended for engaging with a second panel or a component appending from a second panel for the purpose of securing the first panel in a fixed position. Examples of panel-positioning means include, for example, a slit, a slot, a tab, and a flap.

A "fully-erected box" is a box wherein every panel of the box is disposed in its predetermined final disposition, meaning with the cover in closed position.

CONCLUSION, RAMIFICATIONS, AND SCOPE

I have disclosed a box having one or more of the following structural arrangements:

1. (a) An article-retaining structure comprising a cover engagement means and a first panel attached to a top edge of a wall panel and (b) a cover panel having a predetermined front-to-rear length that is substantially shorter than a predetermined front-to-rear length of a bottom panel and a projecting portion disposed adjacent a cover front flap;

2. (a) An article-retaining structure comprising a first panel attached to a top edge of a wall panel and holding a food-containing cup and (b) a cover engagement means that is disposed at least ten millimeters rearward of a front wall panel and (c) a cover panel having a projecting portion covering at least a portion of the food-containing cup;

3. (a) An article-retaining structure comprising a first panel attached to a top edge of a front wall panel and (b) a cover panel that overlies a portion of the first panel and another portion of the first panel being free of coverage by the cover panel; and 4. An article-retaining structure comprising (a) a first panel hingedly attached to an end of a wall panel and (b) a second panel hingedly attached to the first panel and having a panel-positioning means engaging with another panel of the box.

The main object of my invention is a box that provides for easy, efficient packaging of additional articles, such as sauce cups, with other food products. The advantages of my invention are material savings and cost savings as compared to the pertinent prior art.

Within the foregoing discussion of the invention, the labeling of any components as "first" and "second" is for reference purposes only and does not indicate any particular location of the components within the blank or carton. The term "hingedly attached" refers to two panels (or a panel and a flap) joined together at a fold line, and does not imply any degree of movability of the panels in the erected box format.

The illustrated number, size, shape, type, and placement of components represent the preferred embodiment; however, many other combinations and configurations are possible within the scope of the invention.

In conclusion, it is understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

I claim:

1. A blank for a box having an an article-retaining structure and a short-length cover panel, said blank being of foldable material cut and scored to define:

a bottom panel having opposing front and rear bottom panel edges and opposing left and right bottom panel edges and a predetermined front-to-rear length extending between said front and rear bottom panel edges, a plurality of wall panels including respective front and rear wall panels hingedly attached to said front and rear bottom panel edges and respective left and right wall panels hingedly attached to said left and right bottom panel edges, a cover panel having opposing front and rear cover edges and opposing left and right cover edges, said cover panel being hingedly attached to said rear wall panel at said rear cover edge and having a cover front flap hingedly attached at a cover front flap fold line and opposing said rear cover edge and further having a predetermined minimum front-to-rear length extending between said cover front flap fold line and said rear cover edge, and an article-retaining structure comprising a plurality of panels including a first panel hingedly attached to a top edge of said front wall panel at a first fold line and a second panel hingedly attached to said first panel at a second fold line and a cover engagement means for holding said cover panel in a closed disposition after said blank has been erected into said box;

wherein said cover engagement means is disposed adjacent said second fold line and the predetermined minimum front-to-rear length of said cover panel is substantially shorter than the predetermined front-to-rear length of said bottom panel and said cover panel has a projecting portion disposed laterally adjacent to said cover front flap whereby after said blank is erected into said box and a food-containing cup is loaded into said article-retaining structure said projecting portion overlies at least a portion of the cup.

2. The blank of claim 1 wherein:

said left and right cover side edges are free of attachment.

3. The blank of claim 1 wherein:

said article-retaining structure further comprises a panel-positioning means for holding said article-retaining structure in a fixed position after said blank has been erected into said box.

4. The blank of claim 1 further comprising:

respective left and right front corner flaps hingedly attached to a front end of said left and right wall panels.

5. The blank of claim 1 further comprising:

a rear corner flap hingedly attached to a rear end of one of said left and right wall panels.

6. The blank of claim 1 further comprising:

respective left and right front diagonal wall panels hingedly attached to a front end of said left and right wall panels and respective left and right connector panels hingedly attached to a bottom edge of said left and right front diagonal wall panels.

7. The blank of claim 1 further comprising:

another article-retaining structure hingedly attached to an end of one of said left and right wall panels.

8. A combination of a fully-erected box and a food-containing cup, said box being of foldable material and comprising:

a bottom panel having opposing front and rear bottom panel edges and a predetermined front-to-rear length extending between said front and rear bottom panel edges, a plurality of wall panels including a rear wall panel, a cover panel having front and rear cover edges and being hingedly attached to said rear wall panel at said rear cover edge and disposed substantially parallel to said bottom panel and having a predetermined minimum front-to-rear length substantially shorter than the predetermined front-to-rear length of said bottom panel, and an article-retaining structure comprising a first panel attached at a first fold line to a top edge of a wall panel of said plurality of wall panels and disposed substantially parallel to said bottom panel and a cover engagement means for holding said cover panel in a closed disposition;

wherein said food-containing cup is disposed in said article-retaining structure and said cover panel overlies a first portion of said food-containing cup and a second portion of the cup is exposed to view.

9. The combination of claim 8 wherein:

said cover panel has left and right cover edges free of attachment.

10. The combination of claim 8 further comprising:

a cover front flap hingedly attached to said cover panel at a cover flap fold line, said cover panel having a projecting portion extending beyond said cover flap fold line and at least partially overlying a food-containing cup.

11. The combination of claim 8 wherein:

said article-retaining structure further comprises a second panel attached to said first panel at a second fold line and disposed substantially perpendicular to said first panel, said cover engagement means being disposed adjacent said second fold line.

12. The combination of claim 8 wherein:

said article-retaining structure further comprises a second panel attached to said first panel and disposed substantially perpendicular thereto and having at least one panel-positioning tab projecting therefrom.

13. The combination of claim 8 further comprising:

respective left and right front corner flaps hingedly attached to a front end of said left and right wall panels.

14. The combination of claim 8 further comprising:

a rear corner flap hingedly attached to a rear end of one of said left and right wall panels.

15. The combination of claim 8 further comprising:

another article-retaining structure hingedly attached to an end of one of said left and right wall panels.

16. A combination of a fully-erected box and a food-containing cup, said box being of foldable material and comprising:

a bottom panel, a plurality of wall panels including opposing front and rear wall panels, a cover panel hingedly attached to a top edge of said rear wall panel, and an article-retaining structure comprising a first panel hingedly attached to a top edge of a wall panel of said plurality of wall panels and disposed substantially parallel to said bottom panel and a cover engagement means for holding said cover panel in a closed disposition, said cover engagement means being disposed at least ten millimeters rearward of said front wall panel;

wherein said food-containing cup is disposed in said article-retaining structure and said cover panel overlies at least a portion of the food-containing cup.

17. The combination of claim 16 wherein:

said cover panel has left and right cover edges free of attachment.

18. The combination of claim 16 wherein:

said cover has a cover front flap hingedly attached to said cover panel at a cover flap fold line, said cover panel having a projecting portion extending beyond said cover flap fold line and at least partially overlying a food-containing cup.

19. The combination of claim 16 wherein:

at least a portion of the first panel of said article-retaining structure is exposed to view.

20. The combination of claim 16 wherein:

said cover panel overlies a first portion of said food-containing cup and a second portion of the cup is exposed to view.

21. The combination of claim 16 wherein said article-retaining structure further comprises a second panel attached to said first panel at a second fold line and disposed substantially perpendicular to said first panel and said cover engagement means is disposed adjacent said second fold line.

22. The combination of claim 16 wherein:

said article-retaining structure further comprises a second panel attached to said first panel and disposed substantially perpendicular thereto and having at least one panel-positioning tab projecting therefrom.

23. The combination of claim 16 further comprising:

respective left and right front corner flaps hingedly attached to a front end of said left and right wall panels.

24. The combination of claim 16 further comprising:

a rear corner flap hingedly attached to a rear end of one of said left and right wall panels.

25. The combination of claim 16 further comprising:

another article-retaining structure hingedly attached to an end of one of said left and right wall panels.

26. A combination of a fully-erected box and a food-containing cup, said box being of foldable material and comprising:

a bottom panel, a plurality of wall panels including opposing front and rear wall panels, a cover panel hingedly attached to a top edge of said rear wall panel, and an article-retaining structure comprising a first panel hingedly attached to a top edge of said front wall panel and disposed substantially parallel to said bottom panel;

wherein said food-containing cup is disposed in said article-retaining structure and said cover panel overlies a portion of the first panel of said article-retaining structure and another portion of the first panel is free of coverage by said cover panel and said cover panel overlies at least a portion of the food-containing cup.

27. The combination of claim 26 wherein:

said cover panel overlies a first portion of said food-containing cup and a second portion of the cup is exposed to view.

28. The combination of claim 26 further comprising:

another article-retaining structure hingedly attached to an end of one of said left and right wall panels.

29. A combination of a fully-erected box and a food-containing cup, said box being of foldable material and comprising:

a bottom panel having opposing front and rear bottom panel edges and a predetermined front-to-rear length extending between said front and rear bottom panel edges, a plurality of wall panels including a rear wall panel, a cover panel having front and rear cover edges and being hingedly attached to said rear wall panel at said rear cover edge and disposed substantially parallel to said bottom panel and having a predetermined minimum front-to-rear length substantially shorter than the predetermined front-to-rear length of said bottom panel, and an article-retaining structure comprising a first panel attached at a first fold line to a top edge of a wall panel of said plurality of wall panels and disposed substantially parallel to said bottom panel and a cover engagement means for holding said cover panel in a closed disposition;

wherein said food-containing cup is disposed in said article-retaining structure and said cover panel overlies at least a portion of the food-containing cup and said article-retaining structure further comprises a second panel attached to said first panel at a second fold line and disposed substantially perpendicular to said first panel, said cover engagement means being disposed adjacent said second fold line.

* * * * *